US005848908A

United States Patent [19]

Katsuma

[11] Patent Number: 5,848,908

[45] Date of Patent: Dec. 15, 1998

[54] LEVER TYPE CONNECTOR

[75] Inventor: Takatoshi Katsuma, Yokkaichi, Japan

[73] Assignee: Sumitomo Wiring Systems, Ltd., Japan

[21] Appl. No.: 782,265

[22] Filed: Jan. 15, 1997

[30] Foreign Application Priority Data

Jan. 16, 1996 [JP] Japan ..... 8-004741

[51] Int. Cl.[6] ..... H01R 13/62

[52] U.S. Cl. ..... 439/157

[58] Field of Search ..... 439/152–60

[56] References Cited

U.S. PATENT DOCUMENTS 5,474,461 12/1995 Saito et al. ..... 439/157
5,476,391 12/1995 Katsuma ..... 439/157
5,562,465 10/1996 Taguchi et al. ..... 439/157

FOREIGN PATENT DOCUMENTS 5-90843 12/1993 Japan .
5-243928 9/1994 Japan .
7-201409 8/1995 Japan .

*Primary Examiner*—Neil Abrams
*Assistant Examiner*—Eugene G. Byrd
*Attorney, Agent, or Firm*—Banner & Witcoff, Ltd.

[57] ABSTRACT

A c-shaped lever member 30 is attached and supported on a housing 20 by straddling it, plate springs 32*e* are formed on the inner side faces of wing members 32, and stoppers 22*c* are formed on the housing 20 so that they make contact with the plate springs 32*e*. As a result, the plate springs 32*e* do not protrude outwards and are less easily damaged by accident and moreover, a compact lever-type connector 10 is provided.

12 Claims, 3 Drawing Sheets

LEVER TYPE CONNECTOR

TECHNICAL FIELD

The present invention relates to a lever-type electrical connector, and specifically relates to a lever-type connector comprising a spring mechanism which makes a lever move in a specified direction with respect to a housing.

BACKGROUND TO THE INVENTION

A conventional lever-type connector of this kind is described in Laid-Open Publication JIKKAIHEI5-90843, and is shown in FIG. 9 of this specification.

A schematically rectangular shaped housing 1 has a hood 2 constituted by the anterior end portion thereof, and a terminal insertion member 3 constituted by the posterior end portion. The hood 2 has a C-shaped lever 4 provided thereon which grips the hood 2. The lever 4 comprises a transverse member 4*a* which extends in a parallel manner with respect to the upper face of the housing 1, and arms 4*b* which extend from both the ends of the transverse member 4*a* in a parallel manner with respect to the side faces of the housing 1. Supporting pins 2*a* formed on the external side faces of the hood 2 fit into axial holes 4*b*1 formed on the arms 4*b*, thereby pivotably supporting the arms 4*b*.

The external side faces of the housing 1 have protecting walls 5 formed to support the arms 4*b* from the outside. These protecting walls 5 have resilient plastics spring members 5*a* formed so as to protrude towards the arms 4*b*. These spring members 5*a* make contact with the arms 4*b* and lightly apply a force thereon so as to pivot the arms 4*b* in a clockwise direction (as viewed).

However, if the spring members were to be attached to the lever member 4 instead of to the housing 1, they would exposed, resulting in a possibility of damage occurring due to collision with an external object or the like.

The present invention has been developed after taking the above problem into consideration, and aims to present a lever-type connector wherein a plastics spring that is difficult to damage is used in the lever member.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
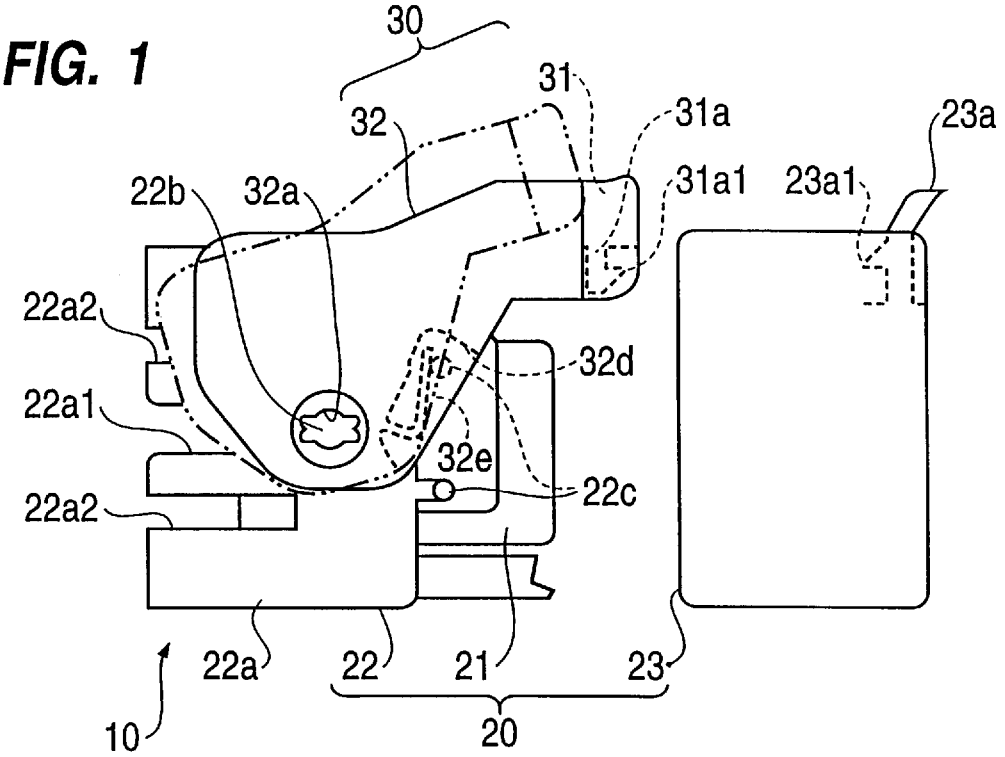
FIG. 1 is a side view of a lever-type connector related to an embodiment of the present invention.

A lever-type connector 10 comprises a schematically angular tubular shaped housing 20 and a lever member 30 which straddle the housing 20. The housing 20 has a terminal insertion member 21 that allows the insertion of terminal fittings in the posterior end side thereof. A tubular hood member 22 is formed so as to widen from the anterior end of the housing 21. The hood member 22 allows the insertion therein of the anterior end portion of a corresponding connector. Side walls 22*a* of the hood member 22 have slots 22*a*1 formed in the centre so as to extend from the anterior end towards the posterior end, these slots 22*a*1 allowing cam pins formed on the side walls of the corresponding connector to be inserted therein and to thereby allow them to protrude outwards. Moreover, two parallel slots 22*a*2 are formed above and below the slots 22*a*1. Position-fixing ribs formed on the side wall faces of the corresponding connector fit into these slots members 22*a*2.

The lever member 30 comprises a base member 31 that approximately corresponds to the width of the hood member 22, and wing members 32 that extend vertically from both ends of the base member 31. The wing members 32 grip the hood member 22. Moreover, the side walls 22*a* of the hood member 22 have supporting pins 22*b* projecting outwards and located more towards the posterior side than the slots 22*a*1. The wing members 32 of the lever member 30 have axial holes 32*a* that allow the insertion of supporting pins 22*b*. Consequently, the lever member 30 straddles the housing 20 and is supported so as to be pivotable within a specified range.

Figure 2:
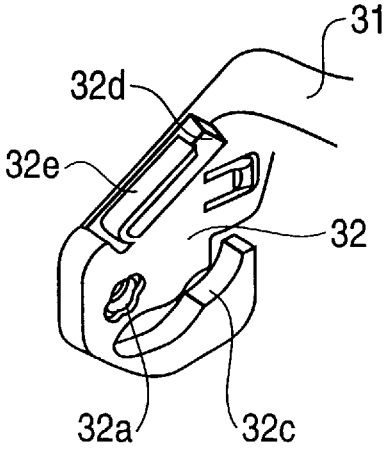
FIG. 2 is a diagonal view of the inner side face of a wing member of the lever-type connector of FIG. 1.

As shown in FIG. 2, the inner sides of the wing members 32 have partially spiral cam grooves 32*c* formed around the axial holes 32*a*. The extreme end of the outer portion of each cam groove 32*c* opens out to the side face of the wing member 32. This opening faces the slots 22*a*1 when the lever member 30 is at an angle corresponding to an initial position, having been rotated in an anti-clockwise direction with respect to the housing 20, as shown in FIG. 1. From this position, when the lever member 30 rotates in a clockwise direction, the cam grooves 32*c* move sideways past the slots 22*a*1, and in the end the inner end portions of the cam grooves 32*c* come to face the inner side of the slots 22*a*1. At this stage, the cam pins of the corresponding connector are pulled towards the inner side of the cam grooves 32*c* within the slots 22*a*1. If the lever member 30 is rotated in the opposite direction, the cam pins are pulled out from the slots 22*a*1. Moreover, the outer face of the housing 20 is formed so as to be vertically symmetrical, and the lever member 30 can be attached either from above or from below.

In the present embodiment, in the housing 20 having the hood member 22 and the terminal insertion member 21 provided as described above, although the lever member 30 with the cam grooves 32*c* is provided, as long as the housing 20 has an approximately tubular shape and a C-shaped lever member 30 straddles its anterior end and is rotatably supported thereon, the shape can be varied according to necessity. Consequently, it may be equally arranged so that, for example, it is the lever member 30 that has the pins and the corresponding connector that has the grooves, and the cross-sectional shape of the housing 20 can be changed so that the angular tubular shape is somewhat rounded. Moreover, the lever member 30 can be attached to the housing 20 either from above or below; although, it can equally be arranged so that attachment is allowed only from a specified direction.

A cover 23 having a lock releasing member 23*a* is attached so as to cover the posterior face of the terminal insertion member 21. A locking member 31*a* is formed on the base member 31 of the lever member 30; this locking member 31*a* locks with the lock releasing member 23*a* when the cover 23 is attached. The locking member 31*a* has a protrusion 31*a*1 projecting from the posterior end thereof, and the lock releasing member 23*a* has a fitting protrusion 23*a*1 that fits with the protrusion 31*a*1. Consequently, when the lock releasing member 23*a* is bent so as to be inclined in a posterior direction, the lock is released.

In the present embodiment, although the cover 23, provided with the lock releasing member 23*a*, is provided independently of the terminal insertion member 21, it may equally be formed uniformly with the terminal insertion member 21. Moreover, the lever member 30 may equally be such as to be fitted and fixed to the other connector.

Figure 3:
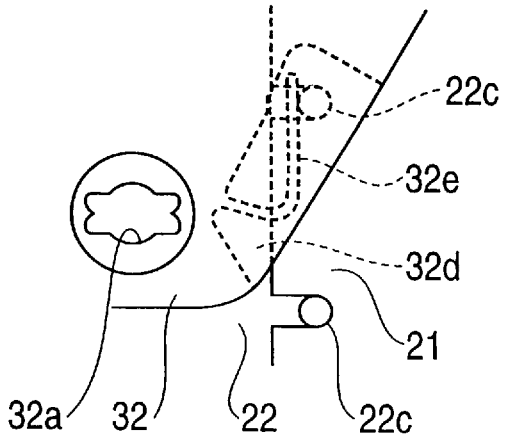
FIG. 3 is a see-through side view showing a spring member and a convex member in the lever-type connector of FIG. 1.

As shown in FIG. 3, the inner side faces of the wing members 32 of the lever member 30 have concave recesses 32*d* formed on a portion facing the posterior face in the clockwise-rotated state. Inside these recesses 32*d* are formed flexible single-support plate springs 32*e* that are supported at one end; these plate springs 32*e* are formed in the circumferential direction with respect to the axial holes 32*a*. Moreover, the housing 20 has stoppers 22*c* formed thereon so as to be capable of making contact with the plate springs 32*e*. When the lever member 30 is rotated in a clockwise direction, the anterior end portions of the plate springs 32*e* are pushed against the stoppers 22*c* and bend. Furthermore, in correspondence with the fact that the lever member 30 can be attached from either above or below, the stoppers 22*c* are also formed in two places, above and below.

That is, when the lever member 30 is pivoted, the plate springs 32*e* apply an opposing force against the lever 30 in a direction opposite to the direction of movement of the lever 30.

Figure 4:
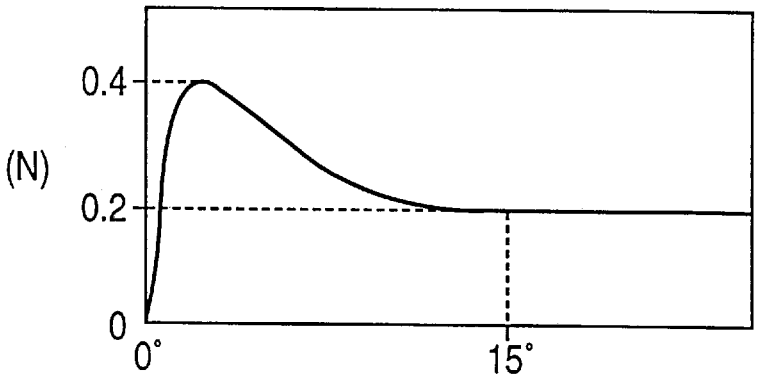
FIG. 4 is a graph showing the load required to be applied on the lever member for a given angular movement.
Figure 5:
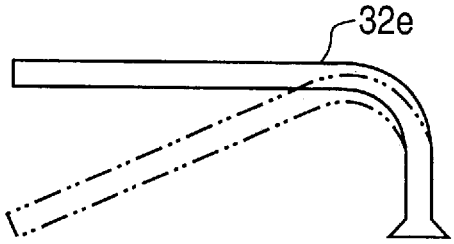
FIG. 5 is a diagram showing the bending of the plate spring.
Figure 6:
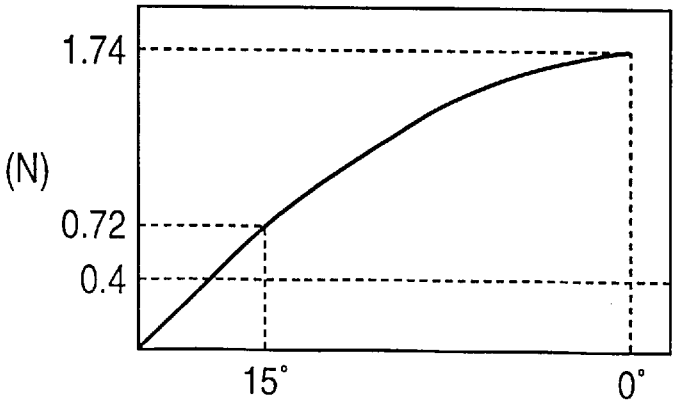
FIG. 6 is a graph showing the load generated by the plate spring as the deflection angle increases.

FIG. 4 shows the maximum load necessary to rotate the lever 30 in the anti-clockwise direction after it has been rotated maximally in the clockwise direction. After releasing the lock, in order to make the operation of the base member 31 easier, it is desirable that it rise up from 0 up to 15; the maximum load in this case is 0.4N. In contrast, as shown in FIG. 6, when the plate springs 32*e* are bent as shown in FIG. 5, in the maximally bent state of 0, a load of 1.74N is generated, and even in the state corresponding to 15 where the bending gradually decreases, a load of 0.72N is generated, which is enough to cause the lever member 30 to rise up.

Figure 7:
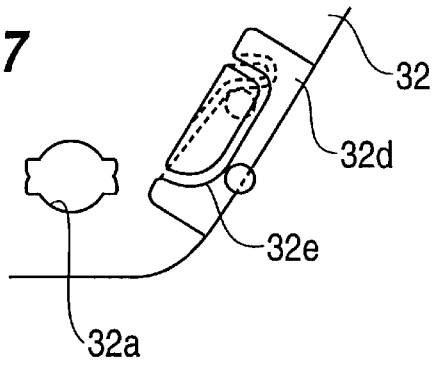
FIG. 7 is a partially enlarged side view of the wing member showing an example of a variation of the plate spring.
Figure 8:
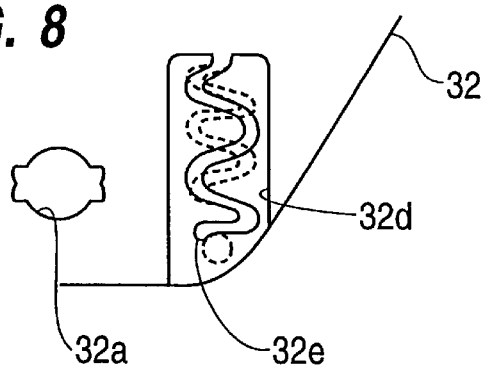
FIG. 8 is a partially enlarged side view of the wing member showing an example of a variation of the plate spring.
Figure 9:
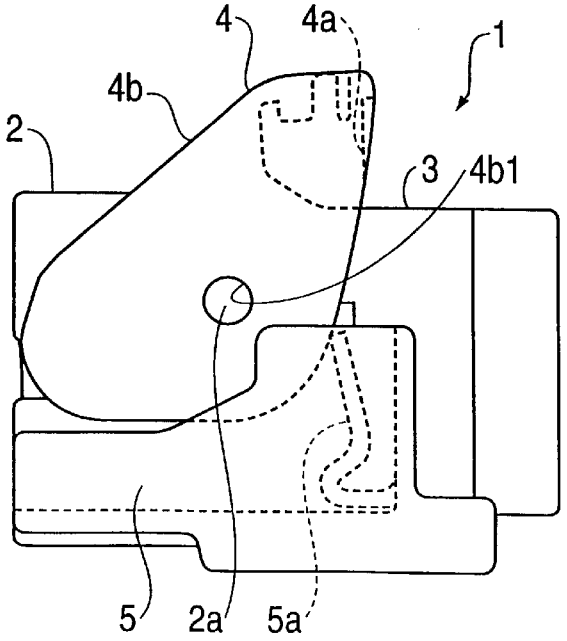
FIG. 9 (PRIOR ART)
FIG. 9 is a side view of a conventional lever-type connector.

In the present embodiment, although the plate springs 32*e* are formed as spring members in the recesses 32*d* opening towards the side faces of the wing members 32, the spring members need not directly face the circumferential direction and may be diagonal as long as they have at least a bending component in at least the circumferential direction. Moreover, although the spring members are formed by means of the single-support plate springs 32*e* supported at one end, in the case where this is insufficient to generate a specified load, twin-support plate springs supported at both ends can be provided, as shown in FIG. 7. In the case of the plate springs supported at both ends, a larger opposing force can be maintained for a longer time. Of course, apart from this, the shape of the plate spring can be changed as required to a curved shape, for example, as shown in FIG. 8.

Moreover, in the case of the present embodiment 1 although it is arranged that during the release of the lock the rotation is limited to making the lever member rise, it may equally be arranged so that the stroke is increased as necessary. However, it is more effective to have an arrangement so that the extent of movement of the rising up is kept short when a plastics spring is formed in a unified manner on to the lever member 30. Furthermore, although the recess 32*d* is formed on the wing member 32, it may be formed either on the interior side face of the lever member 30 or on the inner side face of the base member 31. Of course, in this case the location of the stopper must be altered so that it is located in a corresponding position.

Next, the operation of the embodiment, configured as described above, is explained. The lever member 30 is attached so as to straddle the hood member 22 of the housing 20, and, with the lever member in a pivoted state in the anti-clockwise direction, the corresponding connector is fitted thereto, and gradually the lever member 30 is rotated in the clockwise direction. As the lever member 30 is rotated, the corresponding connector is pulled in, and in the maximally rotated position the two connectors fit and connect, and the locking member 31*a* formed on the base member 31 fits and is fixed firmly with the lock releasing member 23*a* formed on the cover 23.

Just before this final position is reached, the plate spring 32*e* makes contact with the stopper 22*c* and bends, and in the fitted and fixed state the plate spring 32*e* experiences an opposing recovery force. Consequently when the operator inclines backwardly the lock releasing member 23*a* and thereby releases the fitting with the locking member 31*a*, due to the opposing force the wing members 32 rotate slightly. When this happens, the base member 31 reaches a state whereby it is raised from the housing 20, and it becomes easy to raise it with a finger. Moreover, since the plate spring 32*e* is housed in the concave member 32*d*, it cannot easily collide with an external object, and therefore is not damaged easily. Furthermore, a compact lever-type connector 10 is provided.

I claim:

1. A lever-type electrical connector comprising a body with two sides and a lever arm pivotally mounted on the body, the lever arm having a transverse portion, wherein the transverse portion extends across the body and has two ends, the lever arm further having two side arms, one at each end of the transverse portion, each side arm being journalled in a respective side of the body, and having an inner surface adjacent the body, a resilient member being provided on the inner surface of one of said side arms, the body having an abutment engageable with said resilient member to urge said transverse portion away from said body, wherein said side arm having said resilient member has a recess defined in the inner surface thereof and the resilient member is located in said recess.

2. The connector of claim 1 wherein the resilient member projects from the side portion.

3. The connector of claim 2 wherein the resilient member has one free end.

4. The connector of claim 2 wherein the resilient arm is supported by both ends on the lever arm, a camming surface being defined substantially between the ends.

5. The connector of claim 2 wherein the resilient member is convoluted.

6. The connector of claim 1 wherein the resilient member is of plastics material.

7. The connector of claim 1 wherein the resilient member is integrally moulded with the lever arm.

8. The connector of claim 1 wherein the resilient member is integrally moulded with the lever arm.

9. The connector of claim 1 wherein a respective resilient member is provided on each side arm of the lever arm.

10. The connector of claim 1 wherein the abutment is defined on the side of the body adjacent the side arm with the resilient member.

11. The connector of claim 10 wherein the abutment comprises an abutment member projecting from the side of the body.

12. The connector of claim 1 wherein the abutment comprises an abutment member projecting from the side of the body.

* * * * *